US008220636B2

(12) United States Patent
Beecroft et al.

(10) Patent No.: US 8,220,636 B2
(45) Date of Patent: Jul. 17, 2012

(54) CHILD-RESISTANT MULTI-BLISTER CARD CASE

(75) Inventors: W. Gordon Beecroft, Leola, PA (US); Chad E. Rice, Lititz, PA (US)

(73) Assignee: Berry Plastics Corporation, Evansville, IN (US)

( * ) Notice: Subject to any disclaimer, the term of this patent is extended or adjusted under 35 U.S.C. 154(b) by 26 days.

(21) Appl. No.: 12/730,876

(22) Filed: Mar. 24, 2010

(65) Prior Publication Data

US 2010/0264054 A1 Oct. 21, 2010

Related U.S. Application Data

(60) Provisional application No. 61/171,347, filed on Apr. 21, 2009.

(51) Int. Cl.
*B65D 83/04* (2006.01)

(52) U.S. Cl. ..... 206/535; 206/1.5; 206/528; 206/425; 206/499

(58) Field of Classification Search ..... 206/531, 206/535, 536, 1.5, 528, 425, 499, 449, 538, 206/534.1, 534.2, 464, 465, 467, 469, 470, 206/807

See application file for complete search history.

(56) References Cited

U.S. PATENT DOCUMENTS

| | | | | |
|---|---|---|---|---|
| 3,659,706 | A * | 5/1972 | Serrell | 206/539 |
| 4,071,065 | A * | 1/1978 | Halbich | 206/320 |
| 4,192,422 | A | 3/1980 | Kotyuk | |
| 4,932,547 | A | 6/1990 | Rodriguez | |
| 4,998,623 | A * | 3/1991 | Doull | 206/531 |
| 5,074,413 | A * | 12/1991 | Ikuta et al. | 206/320 |
| 5,878,887 | A | 3/1999 | Parker | |
| 6,173,838 | B1 | 1/2001 | Brozell | |
| 6,244,462 | B1 * | 6/2001 | Ehrensvard et al. | 221/7 |
| 6,302,120 | B1 | 10/2001 | Kuo | |
| 6,318,550 | B1 | 11/2001 | Giovinazzi | |
| 6,338,408 | B1 * | 1/2002 | Anderson | 206/538 |
| 6,349,831 | B1 | 2/2002 | Buss | |
| 6,708,826 | B1 * | 3/2004 | Ginsberg et al. | 206/535 |
| 6,752,272 | B2 | 6/2004 | Jones et al. | |
| 6,789,677 | B2 | 9/2004 | Maietta | |
| 6,863,175 | B2 * | 3/2005 | Gelardi | 206/1.5 |
| 6,913,149 | B2 | 7/2005 | Gelardi et al. | |
| 6,951,282 | B2 | 10/2005 | Jones | |
| 7,090,079 | B2 | 8/2006 | Ehrlund | |
| 7,093,736 | B2 | 8/2006 | Maietta | |
| 7,150,355 | B2 | 12/2006 | Coe et al. | |
| 7,188,729 | B2 * | 3/2007 | DeJonge | 206/535 |
| 7,198,149 | B2 | 4/2007 | Gelardi | |
| 7,347,325 | B2 * | 3/2008 | O'Neill et al. | 206/449 |
| 7,357,255 | B2 * | 4/2008 | Ginsberg et al. | 206/535 |
| 7,434,692 | B2 * | 10/2008 | Ginsberg et al. | 206/535 |
| 7,464,819 | B2 | 12/2008 | Maietta | |
| 7,617,935 | B2 * | 11/2009 | Reilley et al. | 206/530 |
| 7,631,764 | B2 * | 12/2009 | Ginsberg et al. | 206/535 |
| 7,661,534 | B2 * | 2/2010 | Saclier et al. | 206/535 |
| 7,726,485 | B2 * | 6/2010 | Brollier | 206/534 |
| 8,011,512 | B2 * | 9/2011 | Brollier et al. | 206/531 |
| 2003/0015438 | A1 * | 1/2003 | Gelardi | 206/1.5 |
| 2004/0026293 | A1 | 2/2004 | Hughes | |
| 2005/0145530 | A1 * | 7/2005 | Gelardi | 206/528 |

(Continued)

*Primary Examiner* — J. Gregory Pickett
*Assistant Examiner* — Andrew Perreault
(74) *Attorney, Agent, or Firm* — Barnes & Thornburg LLP

(57) ABSTRACT

A child-resistant package includes a case and blister cards. The blister cards are mounted for movement between stored positions inside the case and exposed positions outside the case.

31 Claims, 8 Drawing Sheets

U.S. PATENT DOCUMENTS

| | | | | |
|---|---|---|---|---|
| 2006/0006091 | A1 | 1/2006 | Maietta | |
| 2007/0045150 | A1 | 3/2007 | Huffer et al. | |
| 2007/0102318 | A1 | 5/2007 | Gelardi et al. | |
| 2007/0138049 | A1 | 6/2007 | Bitner | |
| 2007/0235368 | A1 | 10/2007 | Knutson et al. | |
| 2007/0261984 | A1 | 11/2007 | Gelardi | |
| 2007/0278124 | A1 | 12/2007 | Saclier et al. | |
| 2008/0251410 | A1 | 10/2008 | Gelardi | |
| 2008/0257773 | A1 | 10/2008 | Gelardi | |
| 2009/0045096 | A1* | 2/2009 | Knutson et al. | 206/570 |

* cited by examiner

CHILD-RESISTANT MULTI-BLISTER CARD CASE

This application claims priority under 35 U.S.C. §119(e) to U.S. Provisional Application Ser. No. 61/171,347, filed Apr. 21, 2009, which is expressly incorporated by reference herein.

BACKGROUND

The present disclosure relates to child-resistant packaging, and particularly to packaging for blister cards. More particularly, the present disclosure relates to containers for storing blister cards.

SUMMARY

A package in accordance with the present disclosure includes a case and a tablet carrier mounted for movement relative to the case. The tablet carrier is configured to carry tablets or other items on a movable sheet.

In illustrative embodiments, the package includes a child-resistant case and a set of blister cards mounted to be moved between stored positions inside the case and exposed positions outside the case. In the exposed positions, users can gain access to tablets carried in the blister cards.

In illustrative embodiments, the blister-card set is stored in an interior card-storage region formed in the base. At least one of the blister cards is coupled to an upstanding anchor post included in the base. A relatively short card-anchor lid is one end of the base coupled to the base by a lid hinge and mated with the upstanding anchor post to retain at least one of the blister cards in the base.

In illustrative embodiments, the package also includes a long card-access lid coupled to another end of the base by a companion lid hinge. The card-access lid can be pivoted about a pivot axis established by the companion lid hinge between a closed position concealing the blister-card set in the base and an opened position exposing the blister-card set.

In illustrative embodiments, the package also includes a lid-pivot controller coupled to the card-access lid to move therewith and configured to establish a child-resistant feature of a monolithic child-resistant case comprising the base, card-anchor lid, card-access lid, and both lid hinges. The lid-pivot controller is configured normally to mate with the card-anchor lid to lock the card-access lid in its closed position. An authorized consumer taught to use lid-pivot controller can operate lid-pivot controller to disengage the card-anchor lid and free the card-access lid so that it can pivot from the closed position to the opened position and thus allow the authorized consumer to gain access to the blister-card set stored in the base.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 9 is a partial perspective assembly view of a free end of the relatively short card-anchor lid (on the left) facing toward a free end of the long card-access lid (on the right) showing a child-resistant feature established by a lid-pivot controller mating with the free end of the long card-access lid and comprising a lid retainer including a pliable wall coupled to the free end of the long card-access lid and two locking lugs coupled to the pliable wall for movement therewith and a retainer mover coupled to the pliable wall to provide means for moving the pliable wall relative to the relatively short card-anchor lid to disengage the locking lugs from engagement with the relatively short card-anchor lid as suggested in FIGS. 13 and 14 to free the long card-access lid to be opened as suggested in FIGS. 15 and 16;

FIGS. 10-12 show how the long card-access lid is locked to the relatively shorter card-anchor lid upon arrival at a closed position on the container;

FIG. 10 is a perspective view of the package showing downward pivoting movement of the long card-access lid toward its closed position on the container;

FIG. 11 is an enlarged sectional view taken along line 11-11 of FIG. 10 showing camming engagement of a downwardly facing cam ramp included in a first of the locking lugs of the lid pivot controller with an edge of the relatively short card-anchor lid during downward pivoting movement of the long card-access lid toward its closed position;

FIG. 12 is a sectional view similar to FIG. 11 taken along line 12-12 of FIG. 13 showing engagement of an upwardly facing pivot-blocking surface on the first locking lug and a downwardly facing bottom wall of the relatively short card-anchor lid to block unauthorized upward pivoting movement of the long card-access lid away from its closed position toward an opened position;

DETAILED DESCRIPTION

Figure 1:
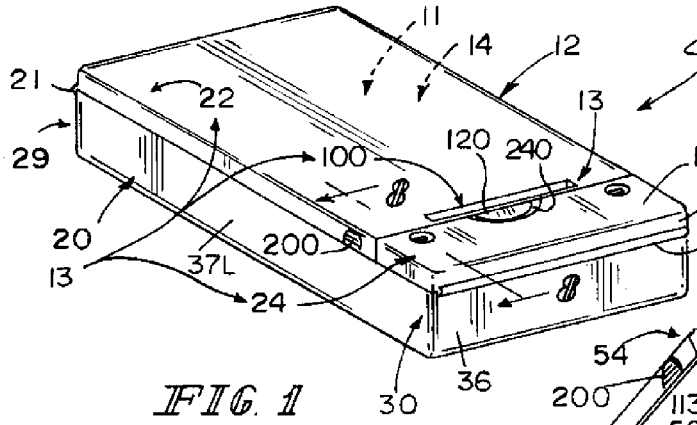
FIG. 1 is a perspective view of a closed blister-card package in accordance with the present disclosure.
Figure 2:
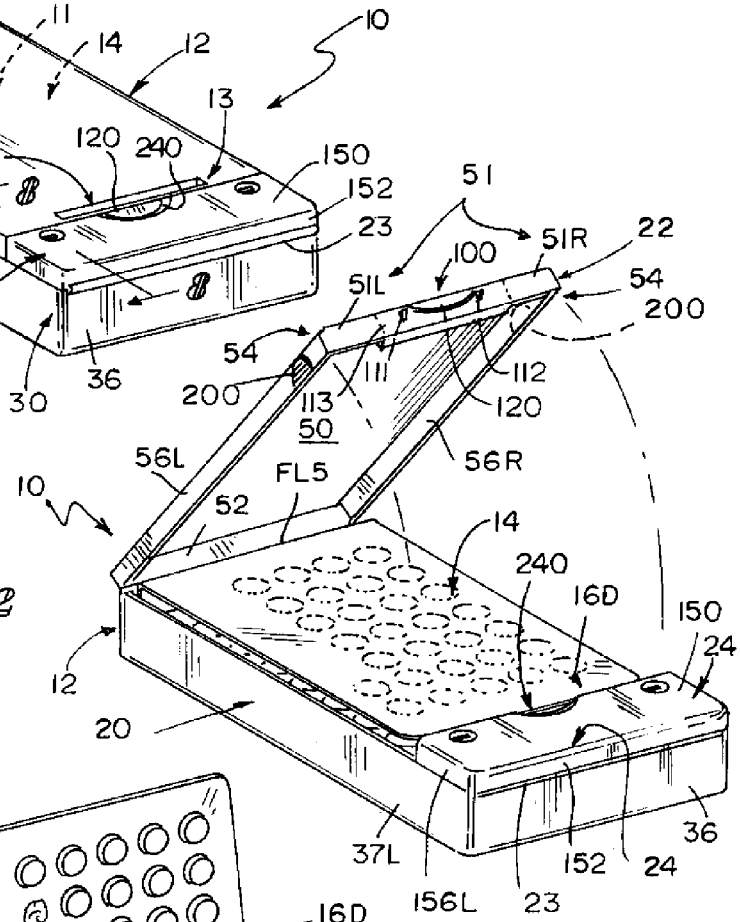
FIG. 2 is a perspective view of the package of FIG. 1 showing that the package includes a base, a set of blister cards stored in an interior card-storage region formed in the base, a long card-access lid mounted on a rear end of the base for pivotable movement relative to the base and partly opened to expose the set of stored blister cards, and a relatively short card-anchor lid mounted on a front end of the base for pivotable movement relative to the base (as suggested in FIGS. 4-8) and closed to retain at least one of the blister cards in an anchored position in the interior region formed in the base (as suggested in FIGS. 2, 3, 8, 13, and 14)

A blister-card package 10 includes a child-resistant case 12 configured to hold a set 14 of multiple blister cards 16A-D as suggested in FIGS. 1-4. Each blister card 16A-D is configured to carry a collection of tablets 15 or other similar small capsules, lozenges, or elements as suggested in FIGS. 3 and 7. Set 14 of blister cards 16A-D are shown in a stored position in FIGS. 1 and 2 and are retained in the stored position in an illustrative manner as suggested in FIGS. 4-8. A lid-pivot controller 100 providing a child-resistant feature of child-resistant case 12 is shown in FIG. 2 and is illustrated in use in FIGS. 9-16. Child-resistant case 12 is also configured to hold another set 114 of multiple blister cards 116A-C to provide a blister-card package 110 as suggested in FIGS. 17 and 18.

Figure 3:
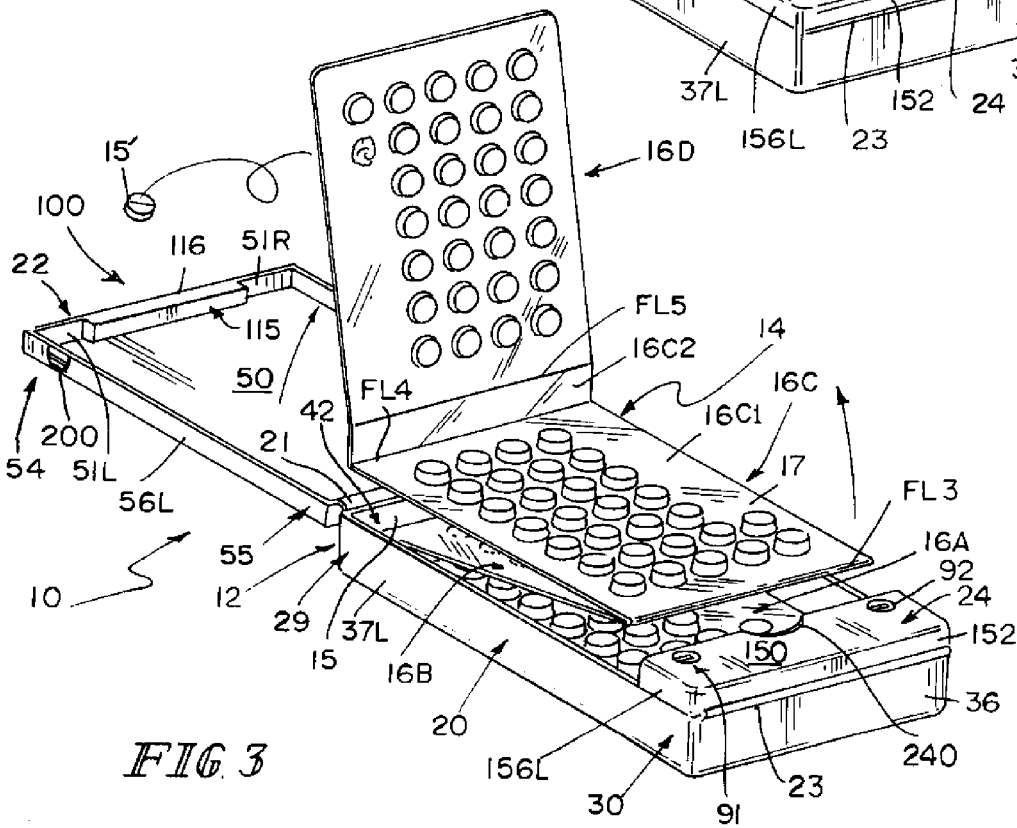
FIG. 3 is a perspective view similar to FIG. 2 showing the long card-access lid in a fully opened position, removal of several of the blister cards from the interior card-storage region formed in the base while the relatively short card-anchor lid remains in a closed position, and removal of a tablet from a tablet-receiving pocket formed in a first of the removed blister cards.
Figure 4:
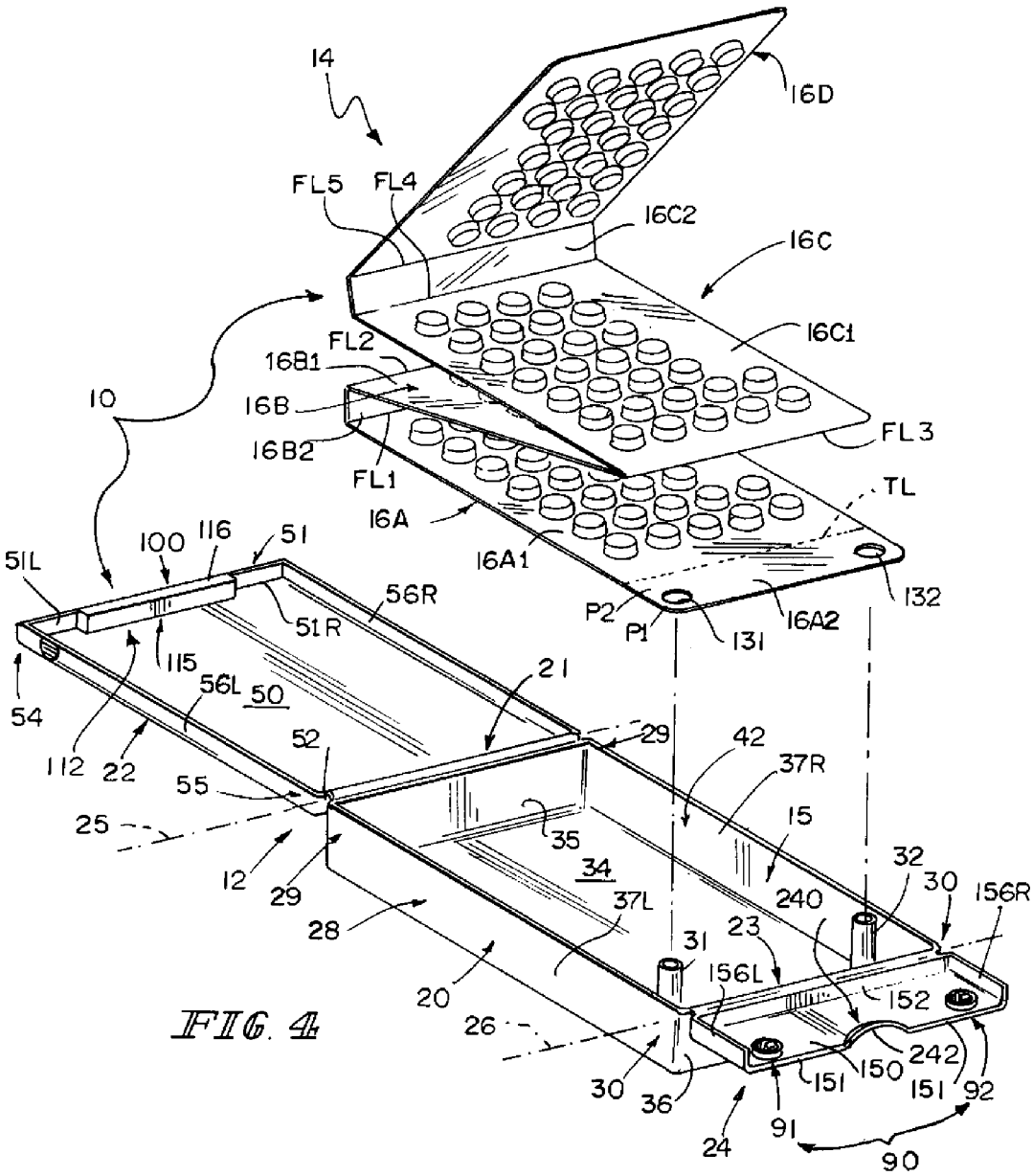
FIG. 4 is an exploded perspective assembly view of the components that cooperate to form the blister-card package of FIGS. 1-3 showing a set of accordion-style interlinked blister cards wherein the bottom (first) blister card includes a tablet-carrying section coupled along a frangible tear line to an anchor section formed to include two separate retention apertures and showing an opened monolithic child-resistant case including, in series, the long card-access lid, a first lid hinge, the base, a second lid hinge, and the relatively short card-anchor lid and showing that the base includes a blister-card container formed to include the interior card-storage region, an upstanding first anchor post coupled to a left side of the case and arranged to lie in the interior card-storage region and an upstanding second anchor post coupled to a right side of the case and arranged to lie in the interior card-storage region in spaced-apart relation to the first anchor post.

Blister-card set 14 has an accordion-style configuration as suggested in FIG. 4. Set 14 includes first (bottom) blister card 16A, second blister card 16B, third blister card 16C, and fourth (top) blister card 16D. Blister cards 16A-D are interconnected in series to lie in end-to-end relation to one another as shown, for example, in FIG. 4. First blister card 16A is tethered to anchor posts 31, 32 included in child-resistant case 12 as suggested in FIGS. 3 and 4 in an illustrative embodiment.

Figure 5:
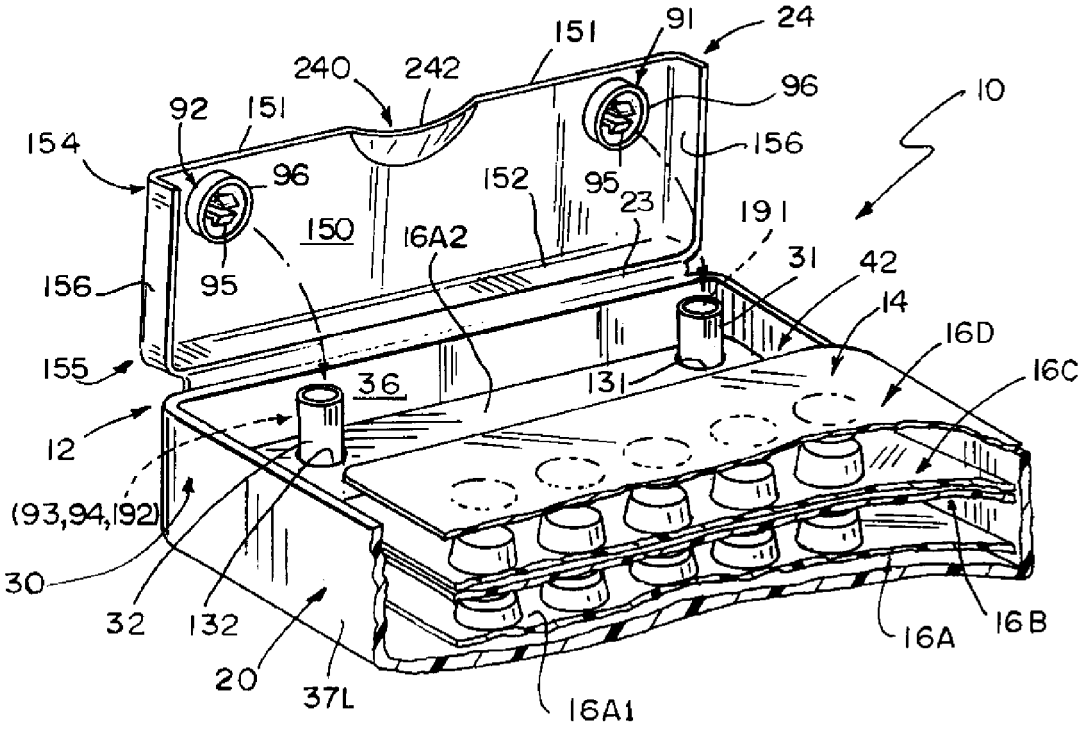
FIG. 5 is an enlarged partial perspective view of a portion of the package shown in FIG. 2 after the bottom (first) blister card in the set of accordion-style interlinked blister cards is mounted on the upstanding first and second anchor posts included in the base and before pivoting movement of the relatively short card-anchor lid toward a closed position on the container.
Figure 6:
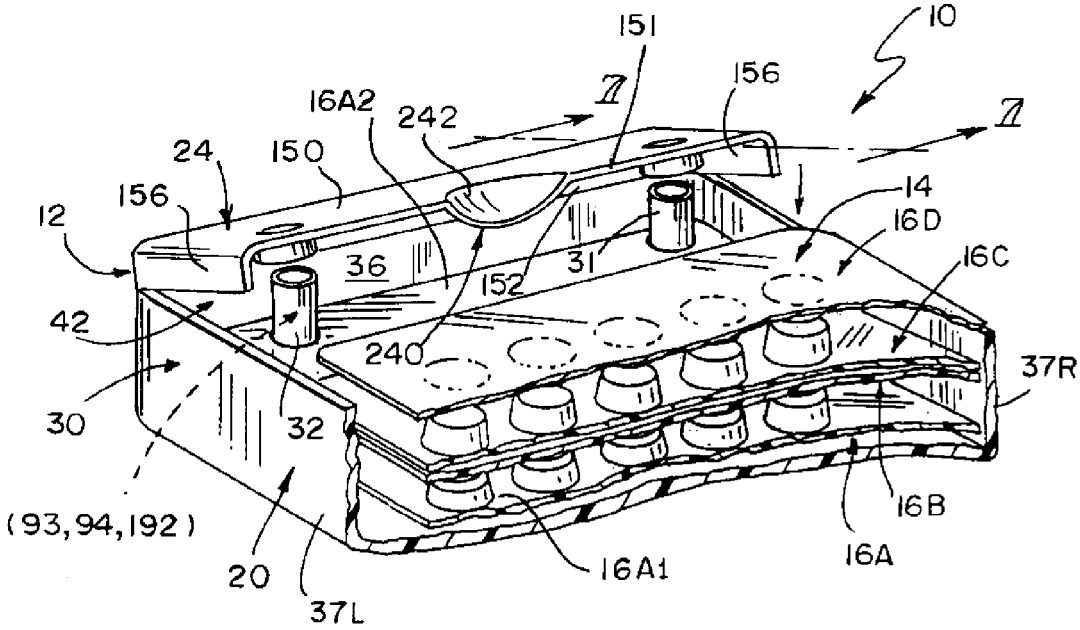
FIG. 6 is a view similar to FIG. 5 showing continued pivoting movement of the relatively short card-anchor lid toward the upstanding first and second anchor posts included in the base.

In the illustrative embodiment shown in FIG. 4, first blister card 16A includes an anchor section 16A2 configured to mate with anchor posts 31, 32 included in child-resistant case 12 as suggested in FIGS. 4-6 normally to tether blister card set 14 to case 12. First blister card 16A also includes a first tablet-carrying section 16A1 and a first end of first tablet-carrying section 16A1 is coupled to anchor section 16A2 along a frangible tear line TL as suggested in FIG. 4.

In the illustrative embodiment shown in FIG. 4, second blister card 16B includes a second tablet-carrying section 16B1 and a connector section 16B2 and third blister card 16C includes a third tablet-carrying section 16C1 and a connector section 16C2. To create an accordion-style blister card set 14 as suggested in FIG. 4, connector section 16B2 is coupled to a second end of first tablet-carrying section 16A1 along a first fold line FL1 and to second tablet-carrying section 16B1 along a second fold line FL2; second tablet-carrying section 16B1 is coupled to the third tablet-carrying section 16C1 along a third fold line FL3; and connector section 16C2 is coupled to third tablet-carrying section 16C1 along a fourth fold line FL4 and to fourth blister card 16D along a fifth fold line FL5.

Figure 7:
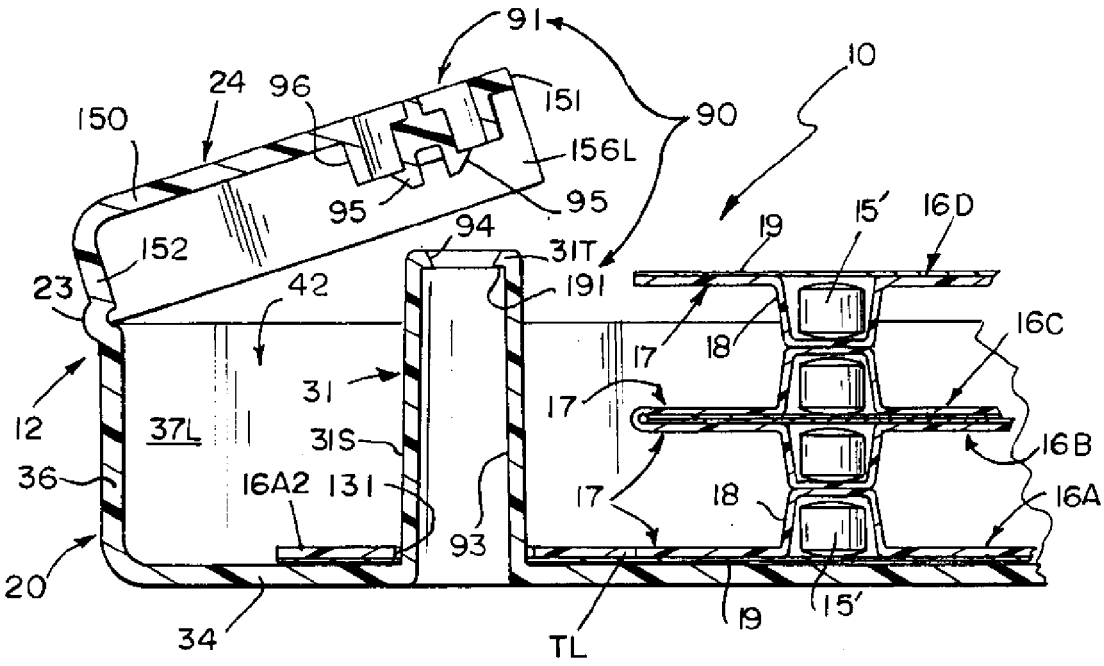
FIG. 7 is an enlarged sectional view taken along line 7-7 of FIG. 6.
Figure 8:
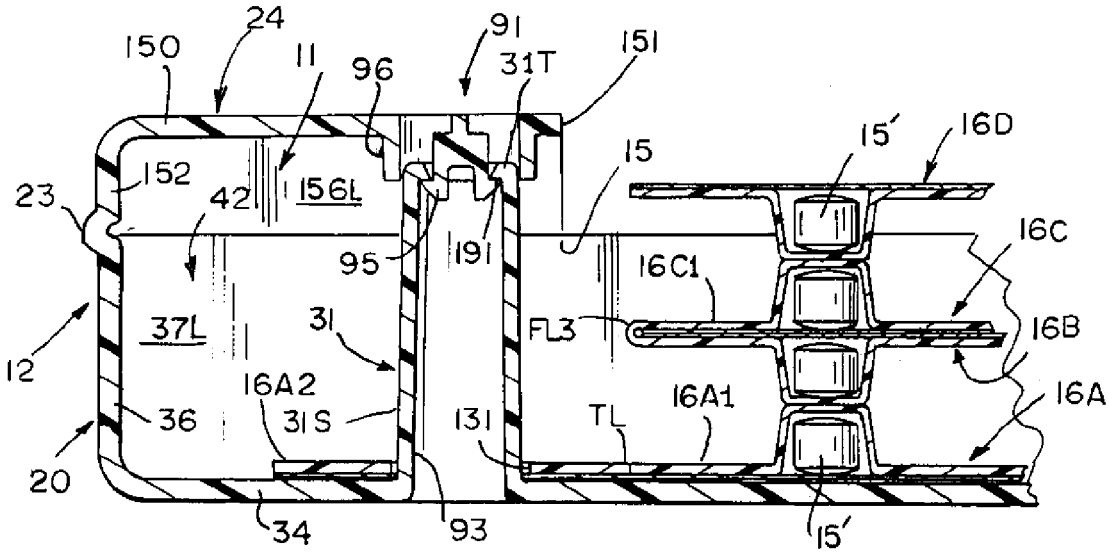
FIG. 8 is an enlarged sectional view taken along line 8-8 of FIG. 1 showing the relatively short card-anchor lid in the closed position on the container and showing mating engagement of a first lid retainer appended to the underside of the relatively short card-anchor lid and a retainer anchor provided in the upstanding first anchor post.

Each of blister cards 16A-D includes a transparent shell 17 made of a suitable material and formed to include a series of tablet-receiving pockets 18 as suggested in FIGS. 3, 7, and 8. Each of blister cards 16A-D also includes a laminate backing layer 19 coupled to a companion shell 17 to retain a tablet 15 in each of pockets 18 until needed by a consumer. Tablets 15 can be removed from companion pockets 18 in the usual way by pushing a tablet 15 through the frangible laminate backing layer 19 (to punch a tablet-discharge opening in laminate backing layer 19) as suggested in FIG. 3. As used herein, a tablet is any element configured to be stored in a pocket 18.

In an illustrative embodiment, child-resistant case 12 is monolithic and thus is formed as a single piece of molded plastics material, in five sections, to include a base 20 (e.g., container 28 and first and second anchor posts 31, 31), a long card-access lid 22, a first lid hinge 21 arranged to interconnect base 20 and card-access lid 22, a relatively short card-anchor lid 24, and a second lid hinge 23 arranged to interconnect base 20 and card-anchor lid 24 as suggested in FIG. 4. First lid hinge 21 is configured to support card-access lid 22 for pivotable movement about a first lid pivot axis 25 relative to base 20 form an opened position shown, for example, in FIGS. 3 and 4, to a closed position shown, for example, in FIGS. 1 and 12-15. Second lid hinge 23 is configured to support card-anchor lid 24 for pivotable movement about a second lid pivot axis 26 relative to base 20 from an opened position shown, for example, in FIG. 4 to a closed position shown, for example, in FIGS. 1-3 and 8-16.

Base 20 of child-resistant case 12 is formed to include a blister-card container 28 having an inner end 29 coupled to first lid hinge 21 and an opposite outer end 30 coupled to second lid hinge 23 as suggested in FIG. 4. Base 20 also includes an upstanding first anchor post 31 coupled to a left-side portion of blister-card container 28 and located near outer end 30 of blister-card container 28 as shown in FIG. 4. Base 20 further includes, in illustrative embodiments, an upstanding second anchor post 32 coupled to a right-side portion of blister-card container 28 and located near outer end 30 of blister-card container 28 and in laterally spaced-apart relation to first anchor post 31 as shown in FIG. 4.

Blister-card set 14 is tethered to first and second anchor posts 31, 32 included in base 20 of child-resistant case 12 in an illustrative manner suggested in FIG. 4. Anchor section 16A2 of first blister card 16A is formed to include a first post-retention aperture 131 sized to receive anchor post 31 therein and a second post-retention aperture 132 sized to receive anchor post 32 therein as suggested, for example, in FIGS. 4-6. Each of blister cards 16A-D in set 14 can be moved by a user relative to child-resistant case 12 as suggested in FIGS. 2 and 3 after a card-access lid 22 in child-resistant case 12 is opened so that the user can gain access to any tablets 15 carried in those blister cards 16A-D. Any tablet 15 carried in tablet-carrying section 16A1 of first blister card 16A can be accessed easily by first separating tablet-carrying section 16A1 from anchor section 16A2 along frangible tear line TL if desired.

As suggested in FIG. 4, in an illustrative embodiment, blister-card container 28 includes a flat bottom plate 34, an upstanding first end wall 35 coupled to plate 34 at inner end 29 and coupled to first lid hinge 21, and an upstanding second end wall 36 coupled to plate 34 at outer end 30 and coupled to second lid hinge 23. Blister-card container 28 also includes a right-side wall 37R coupled to a right-side portion of plate 34 and arranged to extend from first end wall 35 to second end wall 36. A left-side wall 37L included in blister-card container 28 is coupled to a left-side portion of plate 34 and arranged to extend from first end wall 35 to second end wall 36.

An interior card-storage region 42 formed in blister-card container 28 above plate 34 is bounded by walls 35, 36, 37R, and 37L as suggested in FIG. 4. Interior card-storage region 42 is sized to receive blister-card set 14 therein when card-access and card-anchor lids 22, 24 are closed as suggested in FIGS. 1, 2, 15, and 16 and anchor section 16A2 of first blister card 16A is coupled to upstanding anchor posts 31, 32 located in interior card-storage region 42 of blister-card container 28. Each of upstanding anchor posts 31, 32 is arranged to lie at least partly in interior card-storage region 42 of blister-card container 28 a shown, for example, in FIGS. 4 and 5.

As suggested in FIG. 4, card-access lid 22 includes a flat top plate 50, an upstanding first end wall 51 coupled to plate 50 at an outer end 54 of card-access lid 22 and to first lid hinge 23, and an upstanding second end wall 52 coupled to plate 34 at an inner end 55 of card-access lid 22. Card-access lid 22 also includes a left-side wall 56L coupled to a left-side portion of plate 50 and arranged to extend from first end wall 51 to second end wall 52. A right-side wall 56R included in card-access lid 22 is coupled to a right-side portion of plate 50 and arranged to extend from first end wall 51 to second end wall 52. First end wall 51 includes a left section 51L coupled to left-side wall 56L and a separate right section 51R coupled to right-side wall 56R and arranged to lie in laterally spaced-apart relation to left section 51L as suggested in FIG. 4.

As suggested in FIG. 4, card-anchor lid 24 is relatively short as compared to card-access lid 22 in an illustrative embodiment. As shown in FIGS. 4 and 5, card-anchor lid 24 includes a flat top plate 150, an upstanding end wall 152, a left-side wall 156L, and a right-side wall 156R. End wall 152 is coupled to plate 150 at an inner end 155 of card-anchor lid 24 and to second lid hinge 23 as shown best in FIGS. 4 and 5. Plate 150 includes a front edge 151 located at an outer end 154 thereof and arranged to lie in spaced-apart relation to end wall 152 as shown, for example, in FIG. 5. Left-side wall 156L is coupled to a left-side portion of plate 150 and arranged to extend from front edge 151 to end wall 152. Right-side wall 156R is coupled to a right-side portion of plate 150 and arranged to extend from front edge 151 to end wall 152.

Card-anchor lid 24 further includes a finger shell 240 appended to plate 150 at outer end 154 as shown, for example, in FIGS. 5 and 6. Finger shell 240 is arranged to interrupt front edge 151 of plate 150. Finger shell 240 includes a concave surface 242 arranged to face upwardly away from underlying plate 34 of blister-card container 28 when card-anchor lid 24 is moved to assume the closed position as shown, for example, in FIG. 9. Concave surface 242 is formed to define a finger-receiving space sized to receive the finger of a user therein as suggested in FIG. 15 during activation of a lid-pivot controller 100 coupled to access-card lid 22 at outer end 54 to provide the child-resistant feature of child-resistant case 12 in blister-card package 10.

Lid-fastener means 90 is provided for relatively short anchor lid 24 as shown, for example, in FIGS. 4-8, for retaining card-anchor lid 24 in the closed position on container 28 of base 20 to help establish an interior card-storage region 11 of child-resistant case 12 in which set 14 of blister cards 16A-D are stored when they assume their stored positions as suggested in FIGS. 1-4, 13, and 14. Lid-fastener means 90 is configured to hold card-anchor lid 24 in a fixed position relative to underlying base 20. In an illustrative embodiment, interior card-storage region 11 is a hollow space formed between container 28 and a container closure comprising card-anchor lid 24 and card-access lid 22 as suggested in FIGS. 1, 7, 8, and 12.

Lid-fastener means 90 includes a first lid retainer 91 coupled to plate 150. A companion retainer anchor 191 is coupled to first anchor post 31 and arranged to mate with first lid retainer 91 as shown, for example, in FIG. 8 to retain card-anchor lid 24 in the closed position on container 28 of base 20. In illustrative embodiments, lid fastener means 90 also includes a second lid retainer 92 coupled to plate 150. A companion retainer anchor 192 is coupled to second anchor post 32 and arranged to mate with second lid retainer 92 as suggested, for example, in FIG. 5 to retain lid 24 in the closed position on container 28 of base 20.

First anchor post 31 is formed to include a wide-diameter finger-receiver chamber 93 and a narrow-diameter finger-transfer channel 94 having a top aperture opening into interior region 11 and a bottom aperture opening into wide-diameter finger-receiver chamber 93 as suggested, for example, in FIGS. 7 and 8. In an illustrative embodiment, retainer anchor 191 is an annular wall surrounding that bottom aperture and lying at a boundary between finger-transfer channel 94 and finger-receiver channel 93 as shown in FIG. 7.

First lid retainer 91 includes several fingers 95 and a finger carrier 96 coupled to plate 150 of card-anchor lid 24 and arranged to present fingers 95 toward first anchor post 31 as card-anchor lid 24 is moved toward base 20 as shown in FIGS. 5-8. Fingers 95 are arranged to pass through finger-transfer channel 94, extend into finger-receiver chamber 93, and mate with retainer anchor 191 as suggested in FIG. 8 to block separation of card-anchor lid 24 and base 20.

As suggested in FIGS. 5 and 6, second anchor post 32 is similar in shape to first anchor post 31 and is also formed to include a finger-receiver chamber 93, a finger-transfer channel 94, and retainer anchor 192 at a boundary between chamber 93 and channel 94. Second lid retainer 92 includes several fingers 95 and a finger carrier 96 as suggested in FIG. 5. Fingers 95 of second lid retainer 92 mate with retainer anchor 192 as shown in FIG. 8 to help block separation of lid 24 and base 20.

Lid-pivot controller 100 is a child-resistant feature included in child-resistant case 12 and configured normally to block movement of card-access lid 22 from the closed position to the opened position. An adult aware of the function of lid pivot controller 100 can operate lid-pivot controller 100 easily as suggested in FIGS. 13-16 to free card-access lid 22 so that card-access lid 22 can be moved from its closed position shown in FIG. 1 to its opened position shown in FIG. 3 to allow the adult to gain access to tablets 15 stored in multiple blister cards 16A-D.

In an illustrative embodiment, lid-pivot controller 100 is coupled to card-access lid 22 at outer end 54 as suggested in FIGS. 2 and 9-13. Lid-pivot controller 100 includes a lid retainer 110 and a retainer mover 120 coupled to lid retainer 110 as suggested in FIGS. 9-13.

Lid retainer 110 includes a pliable wall 113 coupled to and arranged to interconnect left and right sections 51L, 51R of first end wall 51 of card-access lid 22. Lid retainer 110 also includes first and second locking lugs 111, 112 coupled to pliable wall 113 and arranged to lie in laterally spaced-apart relation to one another to locate retainer mover 20 therebetween. First and second locking lugs 111, 112 are arranged to project away from card-access lid 22 to mate with plate 150 of card-anchor lid 24 and extend underneath front edge 151 of plate 150 when card-access lid 22 is moved to assume its closed position as suggested in FIGS. 9, 12, and 13.

Figure 9:
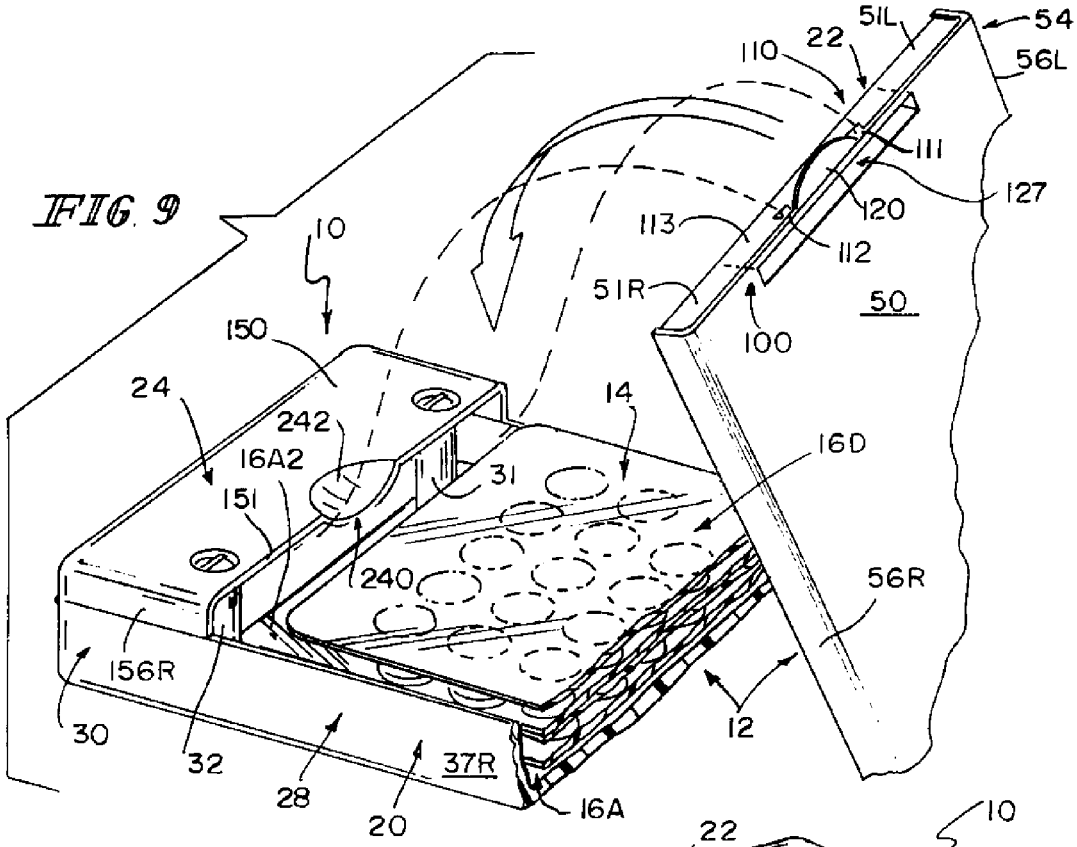
FIGS. 9-12 show operation of a lid-pivot controller coupled to the long card-access lid to establish a child-resistant (CR) feature of the package to limit access to the blister cards in the interior card-storage region formed in the blister-card container to persons aware of the function and operation of the lid-pivot controller.
Figure 10:
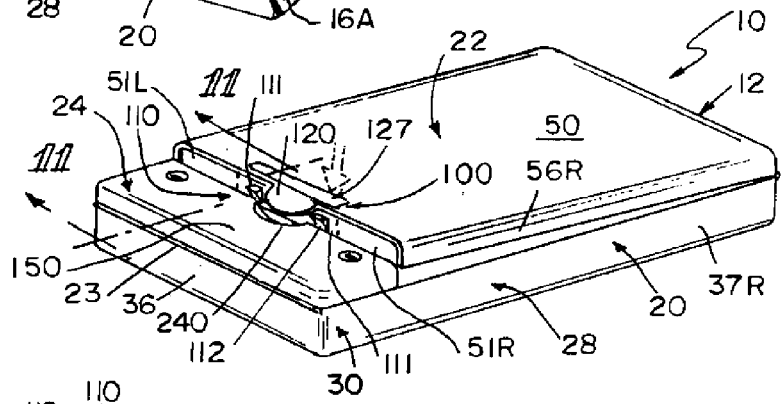

Retainer mover 120 is coupled to an exterior surface of pliable wall 113 and arranged to lie between first and second locking lugs 111, 112 of lid retainer 110 as shown, for example, in FIGS. 9 and 10. Retainer mover 120 is arranged to project outwardly away from pliable wall 113 and fit into the finger-receiving space defined by concave surface 142 of finger shell 140 coupled to neighboring card-anchor lid 24 when card-access lid 22 is moved to assume its closed position on base 20 as suggested in FIGS. 1, 9, 10, and 13.

Lid retainer 110 further includes a stiffener frame 114 coupled to plate 50 and arranged to lie in an interior region of card-access lid 22 in confronting relation to pliable wall 113 as suggested in FIGS. 3, 4, and 11-14. Stiffener frame 114 includes a U-shaped side wall 115 and a bottom wall 116. Bottom wall 116 is arranged to interconnect pliable wall 113 and U-shaped side wall 115 and cooperate with same to form an open cavity 127 as shown, for example, in FIG. 13.

Figure 13:
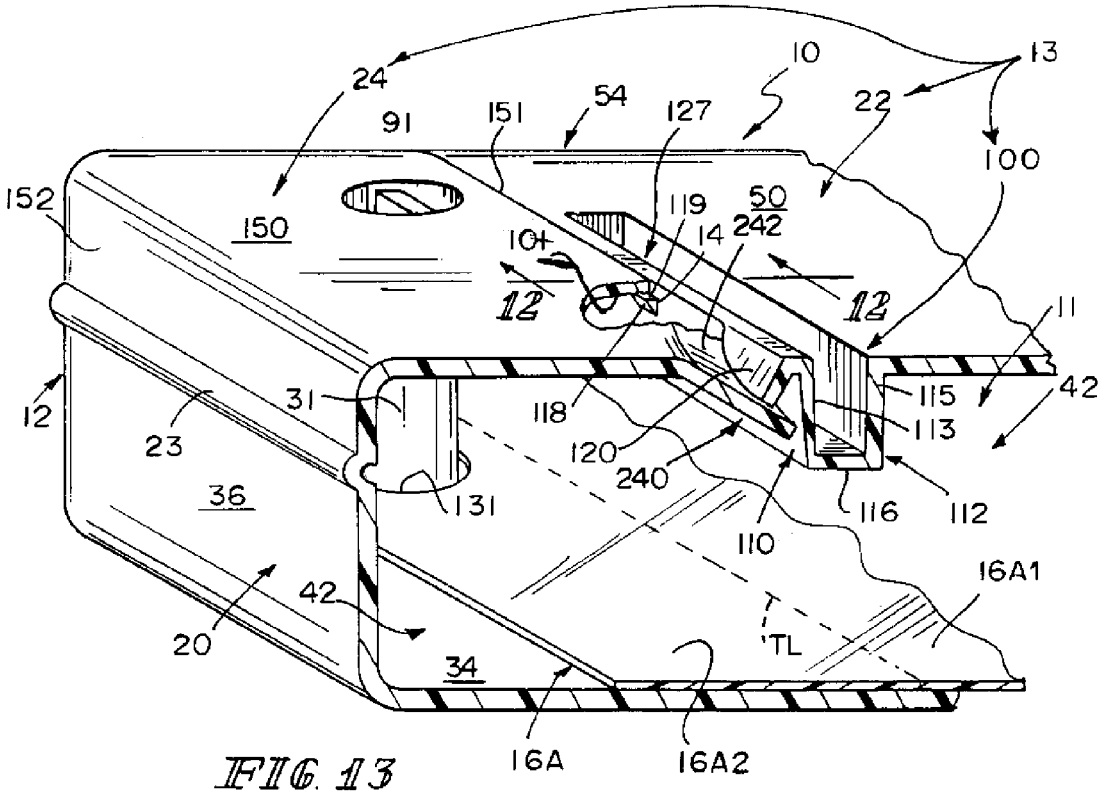
FIG. 13 is a partial perspective view of the package of FIG. 1 while the long card-access lid lies in its closed position on the container, with portions broken away to show engagement of the first locking lug of the lid pivot controller and the relatively shorter card-anchor lid.
Figure 14:
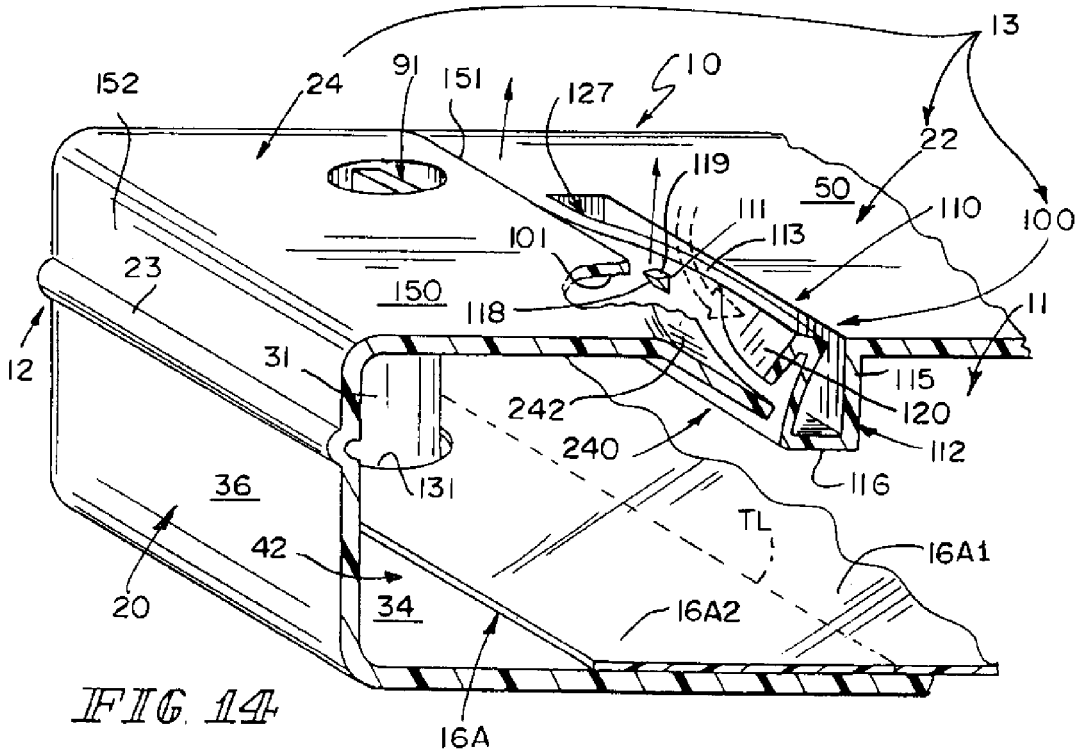
FIG. 14 is a view similar to FIG. 13 showing deflection of the pliable wall included in the lid retainer of the lid-pivot controller to move the first locking lug (to the right) to disengage the relatively short card-anchor lid so that the long card-access lid can be opened as suggested in FIGS. 15 and 16.
Figure 15:
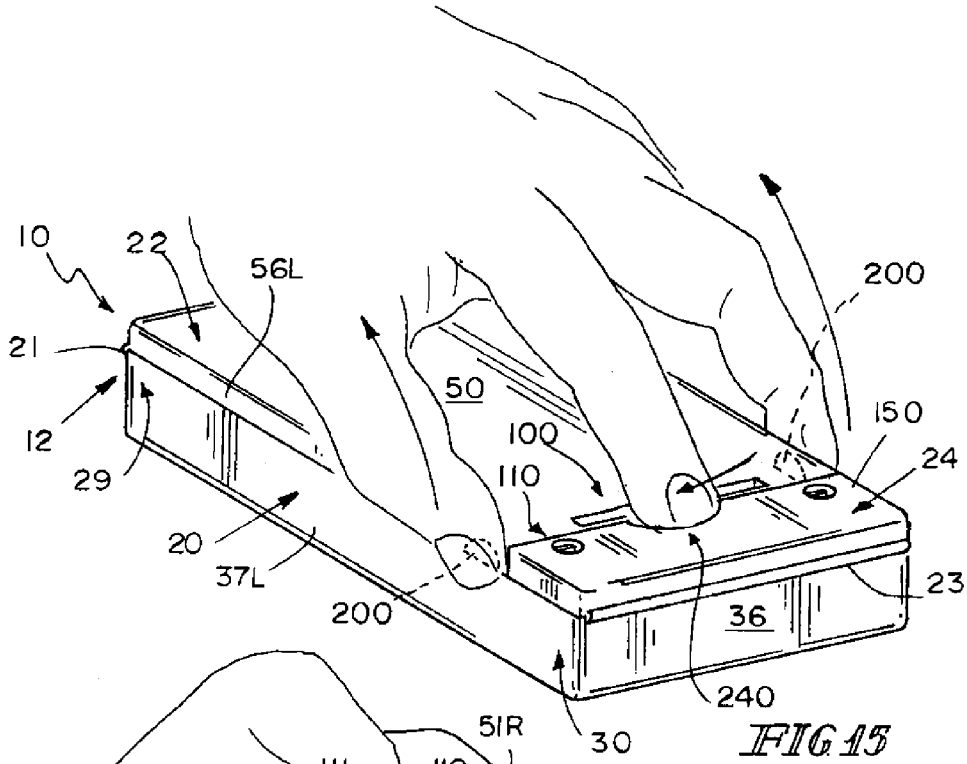
FIG. 15 is a perspective view of the package in the state illustrated in FIG. 14 showing that the deflection of the pliable wall of the lid retainer of the lid-pivot controller is caused by a moving index finger of an adult user.
Figure 16:
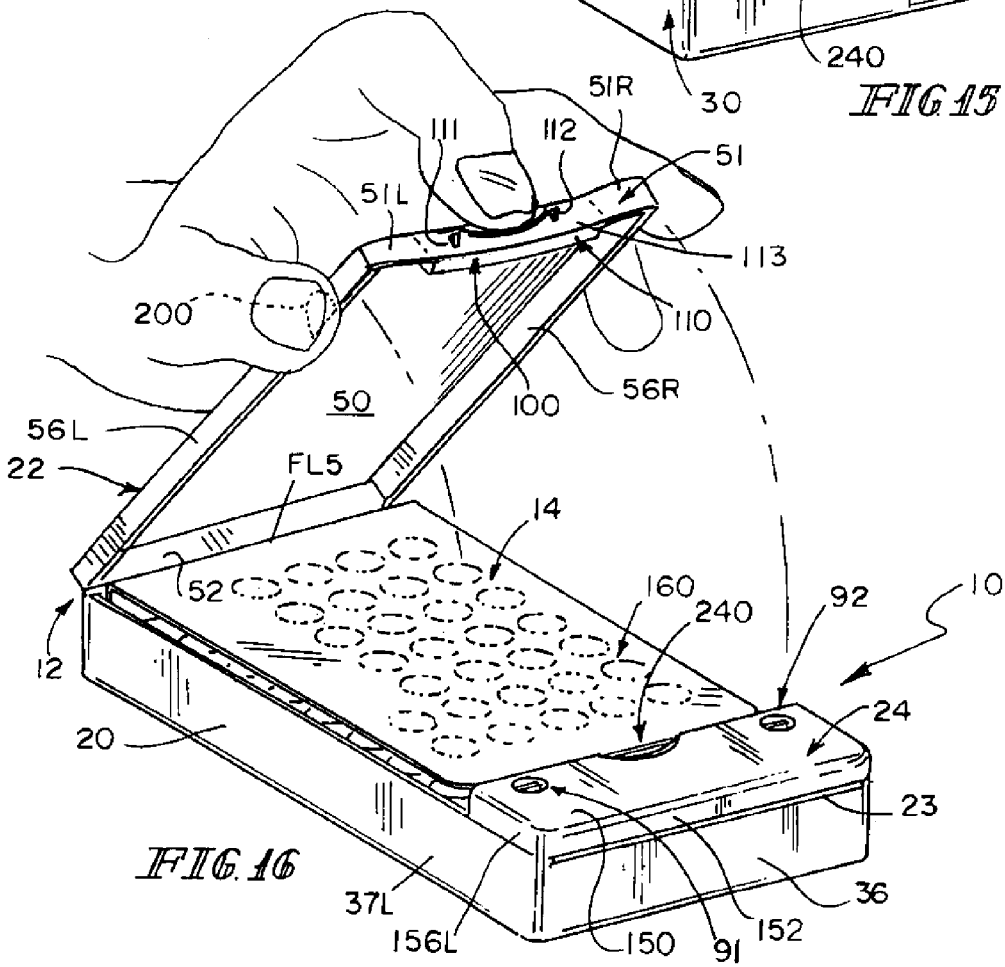
FIG. 16 is a perspective view similar to FIG. 15 showing movement of the long card-access lid to an opened position to expose blister-cards stored in the container.

Retainer mover 120 is configured to provide means for moving pliable wall 113 of lid retainer 10 relative to card-anchor lid 24 to disengage locking lugs 111, 112 from engagement with plate 150 of card-anchor lid 24 as suggested in FIGS. 13-16 to free card-access lid 22 to be opened as suggested in FIGS. 15 and 16. Pliable wall 113 also moves relative to stiffener frame 114 as suggested in FIGS. 13 and 14 when locking lugs 111, 112 are disengaged from card-anchor lid 24. Unless lid-pivot controller 100 is operated properly card-access lid 22 will remain on its closed position as suggested in FIGS. 1 and 12 to block access to set 14 of blister cards 16A-D stored in child-resistant case 12. Lid-pivot controller 100 thus establishes a child-resistant feature of blister-card package 10 to limit access to blister cards 16A-D in interior card-storage region 42 formed in blister-card container 28 to persons aware of the function and operation of lid-pivot controller 100.

Figure 11:
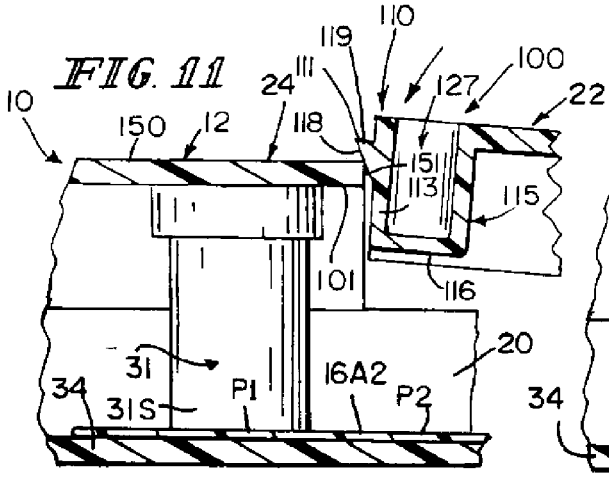
Figure 12:
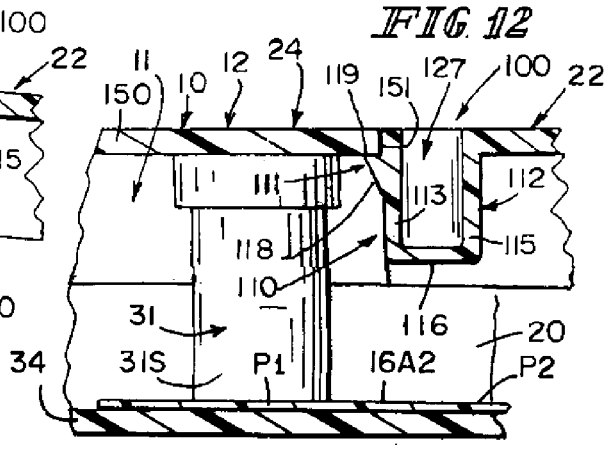

An illustrative manner in which card-access lid 22 is locked to card-retainer lid 24 upon arrival at a closed position on base 20 is shown in FIGS. 10-12. Downward pivoting movement of card-access lid 22 about pivot axis 25 toward its closed position on base 20 is shown, for example, in FIG. 10. Camming engagement of a downwardly facing cam ramp 118 included in first locking lug 111 with front edge 51 of plate 150 of card-anchor lid 24 during downward pivoting movement of card-access lid 22 about pivot axis 24 toward its closed position is shown, for example, in FIG. 11. Engagement of an upwardly facing pivot-blocking surface 119 on first locking lug 111 and a downwardly facing bottom wall 101 of card-anchor lid 24 to block unauthorized upward pivoting movement of card-access lid 24 away from its closed position toward its opened position is shown, for example, in FIG. 13.

Deflection (e.g., elastic deformation) of pliable wall 113 included in lid retainer 110 of lid-pivot controller 100 to move first locking lug 111 (to the right) to disengage card-anchor lid 24 so that card-access lid 22 can be opened as suggested in FIGS. 15 and 16. Deflection of pliable wall 113 of lid retainer 110 of lid-pivot controller 100 is caused, for example, by a moving index finger of an adult user gripping grip pads 200 formed on each of left-side and right-side walls 56L, 56R of card-access lid 22, as suggested in FIG. 15. This frees card-access lid 22 to be moved toward an opened position to expose set 14 of blister cards 16A-D stored in base 20 as suggested in FIG. 16.

Figure 17:
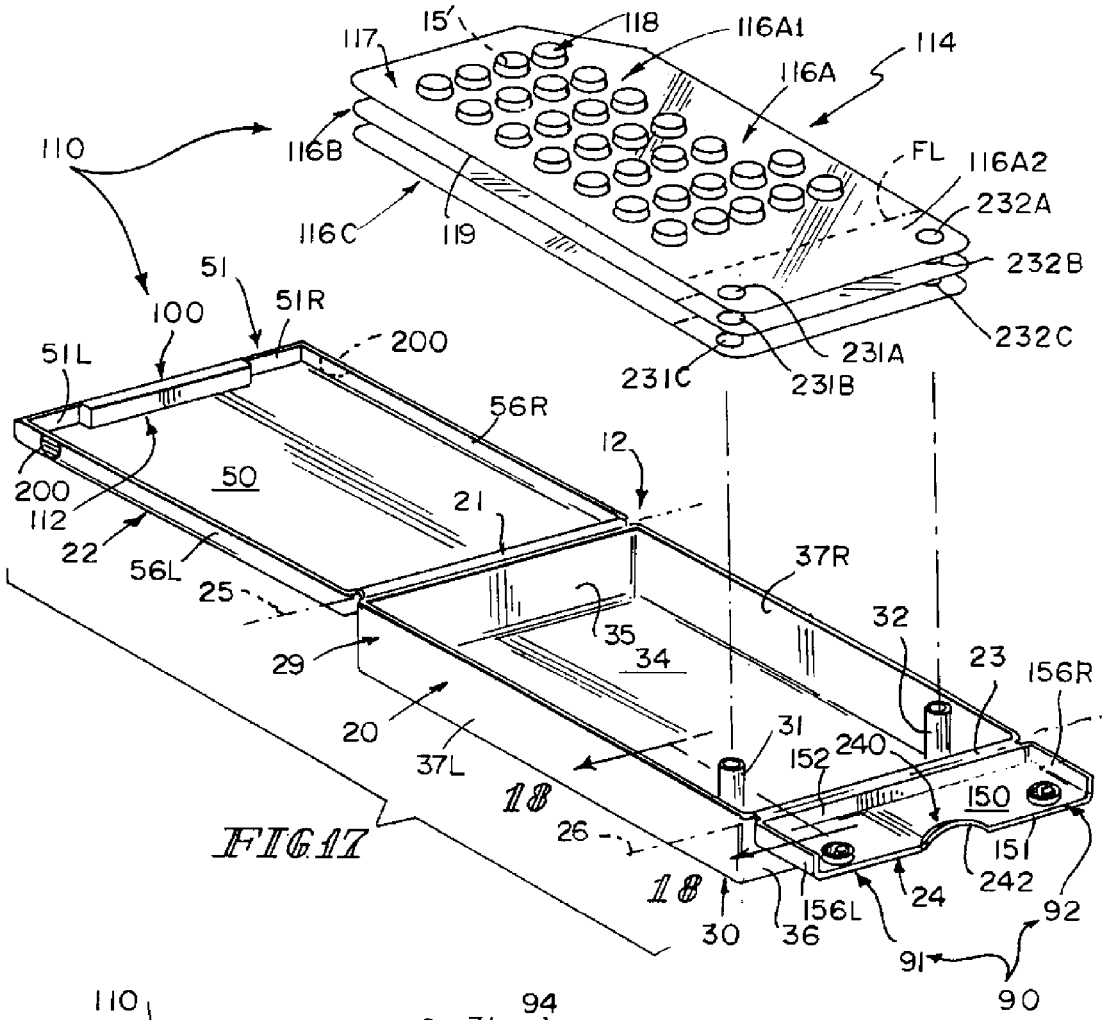
FIG. 17 is an exploded perspective assembly view similar to FIG. 4 showing that the opened monolithic card case of FIGS. 1-16 is adapted to receive and store a different set of blister cards.
Figure 18:
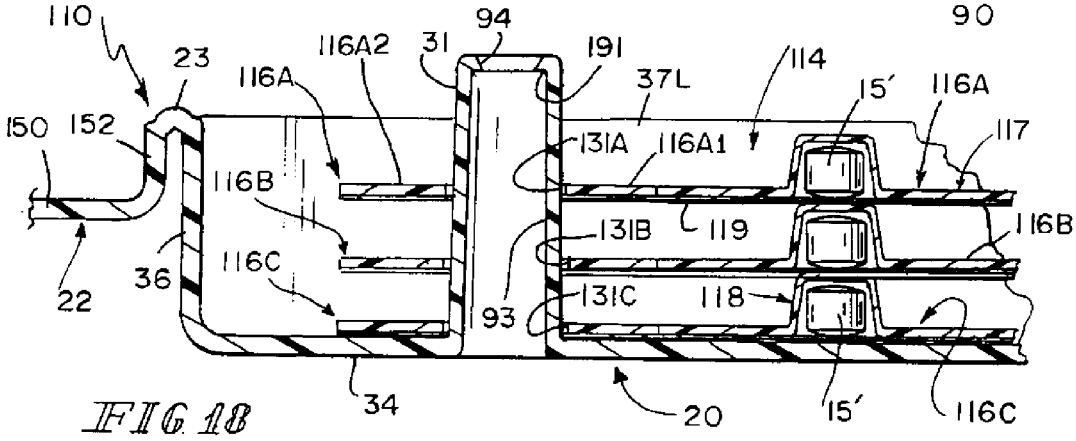
FIG. 18 is an enlarged sectional view taken along line 18-18 of FIG. 17 showing the different set of blister cards stored in the base of the child-resistant case.

A second set 114 of multiple blister cards 116A-C is configured to mate with anchor posts 31, 32 and lie in base 20 of child-resistant case 12 as suggested in FIGS. 17 and 18. Each of blister cards 116A-C has substantially the same shape and configuration as suggested in FIGS. 17 and 18. For example, blister card 116A comprises a tablet-carrying section 116A1 configured to carry tablets 15 and an anchor section 116A2 coupled to tablet-carrying section 116A1 along a frangible tear line (TL) as show in FIG. 17.

Anchor section 116A2 is configured to mate with anchor posts 31, 32 as suggested in FIG. 17 and is thus formed to include a first post retention aperture 231A sized to receive anchor post 31 therein as suggested in FIGS. 17 and 18 and a second post-retention aperture 232A sized to receive anchor post 32 therein as suggested in FIG. 17. The anchor section of blister card 116B is formed to include first and second retention apertures 231B, 232B. The anchor section of blister card 116C is formed to include first and second retention apertures 231C, 232C.

Each of blister cards 116A-C comprises a transparent shell 117 and a frangible laminate backing layer 119 as suggested in FIGS. 17 and 18. Transparent shell 117 is formed to include a series of tablet-receiving packets 118 sized to retain a tablet 15 therein as shown, for example, in FIG. 18.

In an illustrative embodiment, child-resistant case 12 is molded as one piece and then folded in assembly. Each of card-anchor lid 24 and card-access lid 22 is coupled to base 20 by one of the integrally molded lid hinges 21, 23 as suggested in FIG. 4. Child-resistance case 12 is configured to provide resistance of access by a child and allow easy access by an adult.

Package 10 can hold tablets 15 or other items of the type carried in a blister card. Case 12 includes a child-resistant latching system that allows for easy opening by an adult.

In assembly, one or more blister cards is inserted into interior card-storage region 42 formed in base 20 to cause male anchor posts 31, 32 to extend through companion apertures formed in the one or more blister cards. Multiple blister cards can be inserted. Card-anchor lid 24 is folded about pivot axis 26 to assume a closed position mating with anchor posts 31, 32. Snap connections established by a lid-fastener means 90 permanently lock card-anchor lid 24 in a closed position on base 20 to block removal of the blister cards from anchor posts 31, 32.

Next, card-access lid 22 is folded about pivot axis 25 to assume a closed position on base 20. During such closing, locking lugs 111, 112 included in a lid-pivot controller 100 coupled to card-access lid 22 engage front edge 151 of plate 150 of card-anchor lid 24 as suggested in FIGS. 10 and 11. As card-access lid 22 is pushed downwardly toward its closed position, each of locking lugs 111, 112 has a tapered face 118, and with the downward force, face 118 wedges along and deflects a flexible (i.e., pliable) wall 113 to allow locking lugs 111, 112 to pass front edge 151. When locking lugs 111, 112 are fully past front edge 151 (as shown, for example, in FIGS. 12 and 13), pliable wall 113 will spring back (owing to elasticity of material used to form pliable wall 113) to assume a natural deflected condition to produce an audible snapping sound. The interference of locking lugs 111, 112 and plate 150 block lifting movement of card-access lid 22 relative to card-anchor lid 24 toward an opened position. Case 12 in this condition is child-resistant.

In use, blister cards in either of sets 14 or 114 (or other suitable set) can be accessed by an adult pressing on a latch-release button established by retainer mover 120, then lifting card-access lid 22 by finger grips 200 to open and expose non-child-resistant blister cards. Retainer mover 120, in an illustrative embodiment, is designed to be pushed only. Pressing retainer mover 120 overcomes the child-resistant feature. Pressure applied to retainer mover 120 results in deflection of pliable wall 113 which allows locking lugs 111, 112 to clear plate 150 of card-anchor lid 24. In this deflected position, card-access lid 22 is free to be lifted and opened.

After opening case 12, in the case of blister-card set 14, blister cards 16A-D are exposed to be used by consumers. Top card 116A can be accessed by folding the card up and extracting the product in the shell by known methods. When top card 116A has been used completely, it can be folded up out of the way or torn off at a perforation and discarded. This exposes the next blister card to be used by the same method. Closing card-access lid 22 returns package 10 to child-resistance mode.

A medicated-material package 10 includes a case 12 and a tablet carrier 14 as suggested in FIGS. 1-3. Tablet carrier 14 is a set of blister cards in the illustrated embodiment and can be mounted in case 12 as shown, for example, in FIG. 4. Another suitable tablet carrier 114 is shown in FIGS. 16-18.

Case 12 includes a container 28 formed to include an interior card-storage region 42 and a closure 13 mounted on container 28 for movement relative to container 28 to cover a top aperture 15 opening into interior card-storage region 42 as suggested in FIGS. 1-4. Case 12 further includes a first anchor post 31 coupled to container 28 and arranged to lie in interior card-storage region 42 as suggested in FIG. 4.

Tablet carrier 14 is located in interior card-storage region 42 as suggested in FIGS. 2 and 4. Tablet carrier 14 is configured to include a first blister card 16A formed to include a first post-retention aperture 131. First anchor post 31 is arranged to extend through first post-retention aperture 131 to tether the first blister card to the case as suggested in FIGS. 5 and 7. In another illustrative embodiment, tablet carrier 114 includes a first blister card 116A formed to include a first post-retention aperture 231A sized to receive first another post 31 therein as shown in FIGS. 17 and 18.

Closure 13 includes a card-anchor lid 24 configured to mate with container 28 and with first anchor post 31 to block withdrawal of first anchor post 31 from first post-retention aperture 131 and removal of first blister card 16A from interior card-storage region 42 as suggested in FIGS. 4-8. Closure 13 further includes a card-access lid 22 configured to mate with container 28 and cooperate with card-anchor lid 24 to close top aperture 15 opening into interior card-storage region 42 as suggested in FIGS. 1, 2, and 9-12.

First blister card 16A includes an anchor section 16A2 and a first tablet-carrying section 16A1 as suggested in FIG. 4. Anchor section 16A2 is formed to include first post-retention aperture 131. First tablet-carrying section 16A1 is configured to carry tablets 15 and is coupled to anchor section 16A2 along a frangible tear line TL extending therebetween.

First tablet-carrying section 16A1 is arranged to underlie card-access lid 22 upon movement of card-access lid 22 to a closed position mating with container 28 as suggested in FIGS. 1-4. A first portion P1 of anchor section 16A2 is formed to include first post-retention aperture 131 as suggested in FIG. 4 and arranged to underlie card-anchor lid 24 upon movement of card-anchor lid 24 to a closed position mating with container 28 as shown, for example, in FIG. 11. A second portion P2 of anchor section 16A2 is arranged to interconnect tablet-carrying section 16A1 as suggested in FIG. 4 and the first portion of anchor section 16A2 and to underlie card-access lid 22 upon movement of card-access lid 22 to the closed position as shown, for example, in FIG. 12.

Closure 13 further includes a first lid hinge 21 and a second lid hinge 23 as shown, for example, in FIG. 4. First lid hinge 21 is arranged to interconnect container 28 and card-access lid 22. First lid hinge 21 supports card-access lid 22 for pivotable movement about a first lid pivot axis 25 as suggested in FIGS. 1, 2, 15, and 16 between the closed position mated with container 28 to cover first tablet-carrying section 16A1 of first blister card 16A and an opened position separated from container 28 to expose first tablet-carrying section 16A1 of first blister card 16A. Second lid hinge 23 is arranged to interconnect container 28 and card-anchor lid 24. Second lid hinge 23 supports card-anchor lid 24 for pivotable movement about a second lid pivot axis 26 arranged to lie in substantially spaced-apart parallel relation to first lid pivot axis 25 as suggested in FIGS. 4-8 between the closed position mated with container 28 to cover first anchor post 31 and the first portion of anchor section 16A2 and an opened position separated from container 28 to expose a free end of first anchor post 31 and the first portion of anchor section 16A2 so as to free a user to move anchor section 16A2 relative to first anchor post 31 to withdraw first anchor post 31 from first post-retention aperture 131 to untether first blister card 16A from case 12.

Tablet carrier 14 further includes a second blister card 16B configured to carry tablets 15 and coupled to first tablet-carrying section 16A1 of first blister card 16A along a first fold line FL1 as suggested in FIG. 4. First fold line FL1 and frangible tear line TL are arranged to lie in spaced-apart parallel relation to one another. Frangible tear line TL is arranged to lie between first fold line FL1 and first anchor post 31.

Tablet carrier 14 further includes a third blister card 16C as suggested in FIG. 4. Second blister card 16B is arranged to interconnect first and third blister cards 16A and 16C and is coupled to first blister card 16A along first fold line FL1 and to third blister card 16C along a third fold line FL3. Second blister card 16B is arranged to lie between first and third blister cards 16A and 16C when all of blister cards 16A-C are stored in interior card-storage region 42 and arranged to underlie card-access lid 22 upon movement of card-access lid 22 to a closed position mated with container 28.

Container 28 includes a first end wall 35 arranged to lie in spaced-apart relation to first anchor post 31 to locate first tablet-carrying section 16A1 of first blister card 16A and each of second and third blister cards 16B and 16C therebetween when the first, second, and third blister cards 16A-C are stored in interior card-storage region 42 of container 28 as suggested in FIGS. 3-5. First lid hinge 21 is arranged to support card-access lid 22 for pivotable movement about a first lid pivot axis 25 between the closed position mated with container 28 to cover second and third blister cards 16B and 16C and first tablet-carrying section 16A1 of first blister card 16A and an opened position exposing third blister card 16C to free a user to withdraw second and third blister cards 16B and 16C from interior card-storage region 42 of container 28 while first blister card 16A remains tethered to case 12 as suggested in FIGS. 1, 2, 15, and 16.

Card-access lid 22 is supported for movement away from container 28 to open a first portion of top aperture 15 to free second and third blister cards 16B, C for movement out of interior card-storage region 42 through the first portion of top aperture 15 while card-anchor lid 24 remains in a closed position mating with container 28 and first anchor post 31 to close a remaining second portion of top aperture 15 and first blister card 16A remains tethered to case 12 as suggested in FIGS. 15 and 16. Second blister card 16B includes a second tablet-carrying section 16B1 configured to carry tablets 15 and a connector section 16B2. Connector section 16B2 is coupled to first tablet-carrying section 16A1 of first blister card 16A along the first fold line FL1 and to second tablet-carrying section 16B1 of second blister card 16B along a second fold line FL2 and first and second tablet-carrying sections 16A1, 16B1 are arranged to lie in confronting relation to one another when first and second blister cards 16A, B are stored in interior card-storage region 42 as suggested in FIGS. 2 and 4.

Third blister card 16C includes a third tablet-carrying section 16C1 configured to carry tablets 15 as shown, for example, in FIG. 4. Each of the first, second, and third tablet-carrying sections 16A1, 16B1, 16C1 includes a shell 17 formed to include a series of tablet-receiving packets 18 sized to receive a tablet 15 therein and a backing layer 19 coupled to shell 17 to trap tablets deposited in tablet-receiving pockets 18 between backing layer 19 and shell 17 as suggested in FIG. 7. Shells 17 of first and second tablet-carrying sections 16A1, 16B1 are located between backing layers 19 of first and second tablet-carrying sections 16A1, 16B1 and backing layers 19 of second and third tablet-carrying sections 16B1, 16C1 are located between shells 17 of second and third tablet-carrying sections 16B1, 16C1 when first, second, and third blister cards 16A-C are stored in interior card-storage region 42 as also suggested in FIG. 7.

Card-anchor lid 24 includes a plate 150 arranged to overlie first anchor post 31 upon movement of card-anchor lid 24 to a closed position mating with container 28 and lid-fastener means 90 coupled to plate 150 for retaining card-anchor lid 24 in a fixed position on first anchor post 31 to block withdrawal of first anchor post 31 from first post-retention aperture 131 formed in first blister card 16A. Lid-fastener means 90 is arranged to lie in interior card-storage region 42 when card-anchor lid 24 is mated with container 78.

First anchor post 31 includes an upstanding sleeve 31S coupled to a floor 34 of container 28 and formed to include a chamber 93 and a top wall 31T coupled to a free end of upstanding sleeve 31S as suggested in FIGS. 7 and 8. Top wall 31T is formed to include a channel 94 having a bottom aperture opening into chamber 93 and a top aperture opening into interior card-storage region 42. Lid-fastener means 90 includes a first lid retainer 91 that is coupled to plate 150 as suggested in FIG. 4 and arranged to extend into chamber 93 through channel 94 to mate with a retainer anchor 191 included in top wall 31T and located in chamber 93 to fasten card-anchor lid 24 to first anchor post 31 as suggested in FIG. 8.

Case 12 includes a second anchor post 32 coupled to container 28 and arranged to lie in interior card-storage region 42 in spaced-apart relation to first anchor post 31 as suggested in FIG. 4. First blister card 16A is formed to include a second post-retention aperture 132. Lid-fastener means 90 further includes a second lid retainer 92 coupled to plate 150 as suggested in FIG. 4 and configured to mate with second anchor post 32 upon movement of card-anchor lid 24 to the closed position as suggested in FIGS. 5 and 6

Lid-fastener means 90 includes several fingers 95 and a finger carrier 96 coupled to plate 150 and arranged to present fingers 95 toward first anchor post 31 as card-anchor lid 24 is moved toward first anchor post 32 in container 28 as suggested in FIG. 7. Fingers 95 are arranged to pass through a narrow-diameter finger-transfer channel 94 formed in top wall 31T of first anchor post 31, extend into a wide-diameter finger-receiving chamber 93 formed in sleeve 31S included in first anchor post 31 and arranged to extend between container 28 and top wall 31T, and mate with a retainer anchor 191 included in first anchor post 31 and arranged to communicate with wide-diameter finger-receiver chamber 93 as suggested in FIG. 8.

Container 28, first lid hinge 21, card-access lid 22, second lid hinge 23, card-anchor lid 24, and first anchor post 31 cooperate to form a monolithic component made of a plastics material as suggested in FIG. 4. Closure 13 further includes a lid-pivot controller 100 coupled to card-access lid 22 to move therewith as suggested in FIGS. 1-4. Lid-pivot controller 100 is made of the plastics material and included in the monolithic component. Lid-pivot controller 100 further includes a retainer mover 120 coupled to lid-retainer means 110 as suggested in FIGS. 9 and 14. Retainer mover 120 is made of the plastics material and included in the monolithic component.

Lid-pivot controller 100 is configured to include lid-retainer means 110 for mating with card-anchor lid 24 as shown, for example, in FIGS. 9-14 when card-anchor lid 24 is in a closed position mating with container 28 and first anchor post 31 to retain card-access lid 22 in a closed position mating with container 28 and cooperating with card-anchor lid 24 to close top aperture 15 opening into interior card-storage region 42. Lid-retainer means 110 includes a pliable wall 113 and a first locking lug 111 coupled to pliable wall 113 to move therewith during elastic deformation of pliable wall 113 as shown, for example, in FIGS. 9, 13, 14, and 16. First locking lug 111 is arranged to project away from card-access lid 22 to mate with an underside portion of card-anchor lid 24 when card-access lid 22 is moved to assume the closed position on container 28 to block movement of card-access lid 22 away from container 28 to an opened position as suggested in FIGS. 9-12.

Retainer mover 120 is coupled to pliable wall 113 as suggested in FIGS. 9, 13, and 14. Retainer mover 120 is configured to provide means for moving pliable wall 113 relative to card-access lid 22 to disengage first locking lug 111 from mating engagement with the underside portion of card-anchor lid 24 to free card-access lid 22 to be moved by a user to the opened position as suggested in FIG. 14.

Card-access lid 22 includes a top plate 50 having an inner end 55 coupled to first lid hinge 21 included in case 12 and coupled to container 28 and an outer end 54 arranged to lie in confronting relation to card-anchor lid 24 upon movement of card-access and card-anchor lids 22, 24 to the closed positions as suggested in FIGS. 1 and 4. Lid-pivot controller 100 further includes a stiffener frame 115 coupled to the outer end of top plate 150 and to pliable wall 113 as shown, for example, in FIGS. 4, 13, and 14. Stiffener frame 115 is configured to provide means for normally supporting pliable wall 113 in an undeformed shape locating first locking lug 111 in mating engagement with the underside portion of card-anchor lid 24 upon movement of card-access and card-retainer lids 22, 24 to the closed positions as suggested in FIG. 13. Pliable wall 113 is arranged to move relative to stiffener frame 115 during elastic deformation thereof to disengage first locking lug 111 from the underside portion of card-anchor lid 24 as suggested in FIG. 14.

Stiffener frame 115 includes a U-shaped side wall 115 coupled to top plate 50 and a bottom wall 116 arranged to interconnect pliable wall 113 and U-shaped side wall 112 as suggested in FIGS. 11-14. Bottom wall 116 cooperates with pliable wall 113 and U-shaped side wall 112 to form an open cavity 127 as suggested in FIG. 13. Stiffener frame 115 and pliable wall 113 are arranged to extend into interior card-storage region 42 upon movement of card-access and card-anchor lids 22, 24 to the closed positions as suggested in FIG. 13.

Card-anchor lid 24 includes a plate 150 arranged to overlie first anchor post 31 upon movement of card-anchor lid 31 to the closed position as suggested in FIG. 11 and a finger shell 240 appended to plate 150 of card-anchor lid 24 at an outer end thereof as suggested in FIGS. 5 and 6. Finger shell 240 is arranged to interrupt a front edge 151 of plate 150 of card-anchor lid 24. Finger shell 240 includes a concave surface 242 arranged to face upwardly away from an underlying floor 34 of container 28 when card-anchor lid 24 is moved to assume the closed position. Concave surface 242 of finger shell 240 is arranged to lie in confronting relation to retainer mover 120 of lid-pivot controller 100 when the card-anchor and card-access lids 22, 24 are arranged to lie in their closed positions on container 28 and formed to define a finger-receiving space sized to receive the finger of a user grasping retainer mover 120 during activation of lid-pivot controller 100 as suggested in FIGS. 1 and 15.

The invention claimed is:

1. A medicated-material package comprising, a case including a container formed to include an interior card-storage region, a closure mounted on the container for movement relative to the container to cover a top aperture opening into the interior card-storage region, and a first anchor post coupled to the container and arranged to lie in the interior card-storage region, a tablet carrier located in the interior card-storage region and configured to include a first blister card formed to include a first post-retention aperture, wherein the first anchor post is arranged to extend through the first post-retention aperture to tether the first blister card to the case and the closure includes a card-anchor lid configured to mate with the container and with the first anchor post to block withdrawal of the first anchor post from the first post-retention aperture and removal of the first blister card from the interior card-storage region and a card-access lid configured to mate with the container and cooperate with the card-anchor lid to close the top aperture opening into the interior card-storage region, wherein the closure further includes a lid-pivot controller coupled to the card-access lid to move therewith and includes lid-retainer means for mating with the card-anchor lid when the card-anchor lid is in a closed position mating with the container and the first anchor post to retain the card-access lid in a closed position mating, with the container and cooperating with the card-anchor lid to close the top aperture opening into the interior card-storage region, wherein the lid-retainer means includes a pliable wall and a first locking, lug coupled to the pliable wall to move therewith during elastic deformation of the pliable wall and the first locking lug is arranged to project away from the card-access lid to mate with an underside portion of the card-anchor lid when the card-access lid is moved to assume the closed position on the container to block movement of the card-access lid away from the container to an opened position, and wherein the lid-pivot controller further includes a retainer mover coupled to the pliable wall and provides means for moving, the pliable wall relative to the card-access lid and into an open cavity formed at least partially by the pliable wall in the card-access lid to disengage the first locking lug from mating engagement with the underside portion of the card-anchor lid to free the card-access lid to be moved by a user to the opened position.

2. The package of claim 1, wherein the first blister card includes an anchor section formed to include the first post-retention aperture and a first tablet-carrying section configured to carry tablets and coupled to the anchor section along a frangible tear line extending therebetween.

3. The package of claim 2, wherein the first tablet-carrying section is arranged to underlie the card-access lid upon movement of the card-access lid to a closed position mating with the container, a first portion of the anchor section is formed to include the first post-retention aperture and arranged to underlie the card-anchor lid upon movement of the card-anchor lid to a closed position mating with the container, and a second portion of the anchor section is arranged to interconnect the tablet-carrying section and the first portion of the anchor section and to underlie the card-access lid upon movement of the card-access lid to the closed position.

4. The package of claim 3, wherein the closure further includes a first lid hinge arranged to interconnect the container and the card-access lid and support the card-access lid for pivotable movement about a first lid pivot axis between the closed position mated with the container to cover the first tablet-carrying section of the first blister card and an opened position separated from the container to expose the first tablet-carrying section of the first blister card and a second lid hinge arranged to interconnect the container and the card-anchor lid and support the card-anchor lid for pivotable movement about a second lid pivot axis arranged to lie in substantially spaced-apart parallel relation to the first lid pivot axis between the closed position mated with the container to cover the first anchor post and the first portion of the anchor section and an opened position separated from the container to expose a free end of the first anchor post and the first portion of the anchor section to free a user to move the anchor section relative to the first anchor post to withdraw the first anchor post from the first post-retention aperture to untether the first blister card from the case.

5. The package of claim 2, wherein the tablet carrier further includes a second blister card configured to carry tablets and coupled to the first tablet-carrying section of the first blister card along a first fold line.

6. The package of claim 5, wherein the first fold line and the frangible tear line are arranged to lie in spaced-apart parallel relation to one another.

7. The package of claim 5, wherein the frangible tear line is arranged to lie between the first fold line and the first anchor post.

8. The package of claim 1, wherein the tablet carrier further includes second and third blister cards and the second blister card is arranged to interconnect the first and third blister cards and is coupled to the first blister card along a first fold line and to the third blister card along a third fold line and the second blister card is arranged to lie between the first and third blister cards when all of the blister cards are stored in the interior card-storage region and arranged to underlie the card-access lid upon movement of the card-access lid to a closed position mated with the container.

9. The package of claim 8, wherein the container includes a first end wall arranged to lie in spaced-apart relation to the first anchor post to locate the first tablet-carrying section of the first blister card and each of the second and third blister cards therebetween when the first, second, and third blister cards are stored in the interior card-storage region of the container.

10. The package of claim 9, wherein the closure further includes a first lid hinge arranged to interconnect the first end wall and the card-access lid and support the card-access lid for pivotable movement about a first lid pivot axis between the closed position mated with the container to cover the second and third blister cards and the first tablet-carrying section of the first blister card and an opened position exposing the third blister card to free a user to withdraw the second and third blister cards from the interior card-storage region of the container while the first blister card remains tethered to the case.

11. The package of claim 8, wherein the card-access lid is supported for movement away from the container to open a first portion of the top aperture to free the second and third blister cards for movement out of the interior card-storage region through the first portion of the top aperture while the card-anchor lid remains in a closed position mating with the container and the first anchor post to close a remaining second portion of the top aperture and the first blister card remains tethered to the case.

12. The package of claim 11, wherein the second blister card includes a second tablet-carrying section configured to carry tablets and a connector section coupled to the first tablet-carrying section of the first blister card along the first fold line and to the second tablet-carrying section of the second blister card along a second fold line and the first and second tablet-carrying sections are arranged to lie in confronting relation to one another when the first and second blister cards are stored in the interior card-storage region.

13. The package of claim 8, wherein the third blister card includes a third tablet-carrying section configured to carry tablets, each of the first, second, and third tablet-carrying sections includes a shell formed to include a series of tablet-receiving packets sized to receive a tablet therein and a backing layer coupled to the shell to trap tablets deposited in the tablet-receiving pockets between the backing layer and the shell, and the shells of the first and second tablet-carrying sections are located between the backing layers of the first and second tablet-carrying sections and the backing layers of the second and third tablet-carrying sections are located between the shells of the second and third tablet-carrying sections when the first, second, and third blister cards are stored in the interior card-storage region.

14. The package of claim 1, wherein the card-anchor lid includes a plate arranged to overlie the first anchor post upon movement of the card-anchor lid to a closed position mating with the container and lid-fastener means coupled to the plate for retaining the card-anchor lid in a fixed position on the first anchor post to block withdrawal of the first anchor post from the first post-retention aperture formed in the first blister card.

15. The package of claim 14, wherein the lid-fastener means is arranged to lie in the interior card-storage region when the card-anchor lid is mated with the container.

16. The package of claim 14, wherein the first anchor post includes an upstanding sleeve coupled to a floor of the container and formed to include a chamber and a top wall coupled to a free end of the upstanding sleeve and formed to include a channel having a bottom aperture opening into the chamber and a top aperture opening into the interior card-storage region and the lid-fastener means includes a first lid retainer that is coupled to the plate and arranged to extend into the chamber through the channel to mate with a retainer anchor included in the top wall and located in the chamber to fasten the card-anchor lid to the first anchor post.

17. The package of claim 14, wherein the case includes a second anchor post coupled to the container and arranged to lie in the interior card-storage region in spaced-apart relation to the first anchor post, the first blister card is formed to include a second post-retention aperture, and the lid-fastener means includes a first lid retainer coupled to the plate and configured to mate with the first anchor post upon movement of the card-anchor lid to the closed position and a second lid retainer coupled to the plate and configured to mate with the second anchor post upon movement of the card-anchor lid to the closed position.

18. The package of claim 14, wherein the lid-fastener means includes several fingers and a finger carrier coupled to the plate and arranged to present the fingers toward the first anchor post as the card-anchor lid is moved toward the first anchor post in the container and the fingers are arranged to pass through a narrow-diameter finger-transfer channel formed in a top wall of the first anchor post, extend into a wide-diameter finger-receiver chamber formed in a sleeve included in the first anchor post and arranged to extend between the container and the top wall, and mate with a retainer anchor included in the first anchor post and arranged to communicate with the wide-diameter finger-receiver chamber.

19. The package of claim 1, wherein the closure further includes a first lid hinge arranged to interconnect the container and the card-access lid and support the card-access lid for pivotable movement about a first lid pivot axis between the closed position mated with the container to cover the first tablet-carrying section of the first blister card and an opened position separated from the container to expose the first tablet-carrying section of the first blister card and a second lid hinge arranged to interconnect the container and support the card-anchor lid for pivotable movement about a second lid pivot axis arranged to lie in substantially spaced-apart parallel relation to the first lid pivot axis between the closed position mated with the container to cover the first anchor post and the first portion of the anchor section and an opened position separated from the container to expose a free end of the first anchor post and the first portion of the anchor section to free a user to move the anchor section relative to the first anchor post to withdraw the first anchor post from first post-retention aperture to untether the card from the case, and wherein the container, first lid hinge, card-access lid, second lid hinge, card-anchor lid, and first anchor post cooperate to form a monolithic component made of a plastics material.

20. The package of claim 19, wherein the closure further includes a lid-pivot controller coupled to card-access lid to move therewith and configured to define lid-retainer means for mating with the card-anchor lid when the card-anchor lid is in a closed position mating with the container and the first anchor post to retain the card-access lid in a closed position mating with the container and cooperating with the card-anchor lid to close the top aperture opening into the interior card-storage region and wherein the lid-pivot controller is made of the plastics material and included in the monolithic component.

21. The package of claim 20, wherein the lid-pivot controller further includes a retainer mover coupled to the lid-retainer means and configured to define retainer-mover means for temporarily deforming the lid-retainer means to separate a first locking lug included in the lid-retainer means from mating engagement with the card-anchor lid to free the card-access lid to be moved by a user relative to the container and away from the card-anchor lid while the card-anchor lid remains in the closed position to allow the user to gain access to the first blister card in the interior card-storage region while the first blister card remains tethered to the first anchor post and wherein the retainer mover is made of the plastics material and included in the monolithic component.

22. The package of claim 1, wherein the card-access lid includes a top plate having an inner end coupled to a first lid hinge included in the case and coupled to the container and an outer end arranged to lie in confronting relation to the card-anchor lid upon movement of the card-access and card-anchor lids to the closed positions, the lid-pivot controller further includes a stiffener frame coupled to the outer end of the top plate and to the pliable wall and configured to provide means for normally supporting the pliable wall in an undeformed shape locating the first locking lug in mating engagement with the underside portion of the card-anchor lid upon movement of the card-access and card-retainer lids to the closed positions and wherein the pliable wall is arranged to move relative to the stiffener frame during elastic deformation thereof to disengage the first locking lug from the underside portion of the card-anchor lid.

23. The package of claim 22, wherein the stiffener frame includes a U-shaped side wall coupled to the top plate and a bottom wall arranged to interconnect the pliable wall and the U-shaped side wall and the bottom wall cooperates with the pliable wall and the U-shaped side wall to form the open cavity.

24. The package of claim 22, wherein the stiffener frame and the pliable wall are arranged to extend into the interior card-storage region upon movement of the card-access and card-anchor lids to the closed positions.

25. The package of claim 1, wherein the card-anchor lid includes a plate arranged to overlie the first anchor post upon movement of the card-anchor lid to the closed position and a finger shell appended to the plate of the card-member lid at an outer end thereof, the finger shell is arranged to interrupt a front edge of the plate of the card-anchor lid, and the finger shell includes a concave surface arranged to face upwardly away from an underlying floor of the container when the card-anchor lid is moved to assume the closed position, and the concave surface is arranged to lie in confronting relation to the retainer mover when the card-anchor and card-access lids are arranged to lie in their closed positions on the container and formed to define a finger-receiving space sized to receive the finger of a user grasping the retainer mover during activation of the lid-pivot controller.

26. A medicated-material package comprising:

a case including a container formed to include an interior card-storage region and a closure mounted on the container for movement relative to the container to cover a top aperture opening into the interior card-storage region formed in the container, and a tablet carrier located in the interior card-storage region, wherein the closure includes a card-access lid, a first lid hinge coupled to the container and the card-access lid to support the card-access lid for pivotable movement about a first lid pivot axis between a closed position mating with the container and an opened position exposing a first portion of the tablet carrier located in the interior card-storage region, a card-anchor lid, and a second lid hinge arranged to lie in spaced-apart parallel relation to the first lid pivot axis and coupled to the container and the card-anchor lid to support the card-anchor lid for pivotable movement about a second lid pivot axis between a closed position mating with the container to cooperate with the card-access lid when the card-access lid is moved to assume the closed position to close the top aperture opening into the interior card-storage region and an opened position exposing a remaining second portion of the tablet carrier located in the interior card-storage region, and wherein the closure further includes a lid-pivot controller made of the plastics material and included in the monolithic component and coupled to the card-access lid to move therewith, the lid-pivot controller defines a lid retainer, a pliable wall, and a first locking lug coupled to the pliable wall to move therewith during elastic deformation of the pliable wall and arranged to project away from the card-access lid normally to mate with the card-anchor lid when the card-access lid is moved to assume the closed position on the container, and the lid-pivot controller also defines a retainer mover coupled to the pliable wall and provides means for moving the pliable wall relative to the card-access lid and into an open cavity formed at least partially by the pliable wall in the card-access lid to disengage the first locking lug from the card-anchor lid to free the card-access lid to be moved by a user to the opened position.

27. The package of claim 26, wherein the container, first lid hinge, card-access lid, second lid hinge, and card-anchor lid cooperate to form a monolithic component made of a plastics material.

28. The package of claim 26, wherein the closure further includes a lid-pivot controller coupled to the card-access lid to move therewith, the lid-pivot controller is configured to define a lid retainer, a pliable wall, and a first locking lug coupled to the pliable wall to move therewith during elastic deformation of the pliable wall and arranged to project away from the card-access lid normally to mate with the card-anchor lid when the card-access lid is moved to assume the closed position on the container, and the lid-pivot controller is also configured to define a retainer mover coupled to the pliable wall and configured to provide means for moving the pliable wall relative to the card-access lid to disengage the first locking lug from the card-anchor lid to free the card-access lid to be moved by a user to the opened position.

29. The package of claim 26, wherein the tablet carrier is formed to include a first post-retention aperture and the case includes a first anchor post arranged to extend through the first post-retention aperture to tether the tablet carrier to the case.

30. The package of claim 29, wherein the first anchor post, the container, first lid hinge, card-access lid, second lid hinge, and card-anchor lid cooperate to form a monolithic component made of a plastics material.

31. The package of claim 29, wherein the card-anchor lid is configured to mate with the first anchor post upon movement of the card-anchor lid to the closed position to trap the tablet carrier in the interior card-storage region.

* * * * *